United States Patent [19]

Hall et al.

[11] Patent Number: 4,688,486

[45] Date of Patent: Aug. 25, 1987

[54] MULTI-HEAD MILITARY CHARGE

[75] Inventors: Henri Hall, Poissy; Jean P. Rouget, Paris, both of France

[73] Assignee: Thomson Brandt Armements, Paris, France

[21] Appl. No.: 685,780

[22] Filed: Dec. 24, 1984

[30] Foreign Application Priority Data

Dec. 27, 1983 [FR] France ..... 83 20839

[51] Int. Cl.[4] ..... F42B 13/26; F42B 13/50

[52] U.S. Cl. ..... 102/489; 102/393

[58] Field of Search ..... 102/489, 351, 357, 393; 89/1.14

[56] References Cited

U.S. PATENT DOCUMENTS

| | | | |
|---|---|---|---|
| 2,972,946 | 2/1961 | Poulter | 102/393 |
| 3,295,444 | 1/1967 | Cushing et al. | 102/393 |
| 3,461,801 | 8/1969 | Vitale et al. | 102/357 |
| 4,455,943 | 6/1984 | Pinson | 102/489 |

FOREIGN PATENT DOCUMENTS

| | | | |
|---|---|---|---|
| 1605122 | 12/1981 | United Kingdom | 102/489 |

*Primary Examiner*—Deborah L. Kyle
*Assistant Examiner*—Michael J. Carone
*Attorney, Agent, or Firm*—Cushman, Darby & Cushman

[57] ABSTRACT

A multi-head military charge for dispersing multiple warheads from a vehicle has a carrier structure for carrying the projectiles. The carrying structure includes an ejectable casing and a central tube which is substantially coaxial with the longitudinal axis of the carrying vehicle. The central tube holds an annular support upon which the projectiles rest. A plurality of resilient securing devices hold the projectiles onto the annular support member. Each securing device has a bolt for clamping the securing device to the associated projectile. Ejector pistons are disposed within the carrier structure to propel each of the projectiles outside of the vehicle. Each ejector piston simultaneously releases the bolt clamping the securing device to the associated projectile and projects the projectile outside of the carrying vehicle.

10 Claims, 7 Drawing Figures

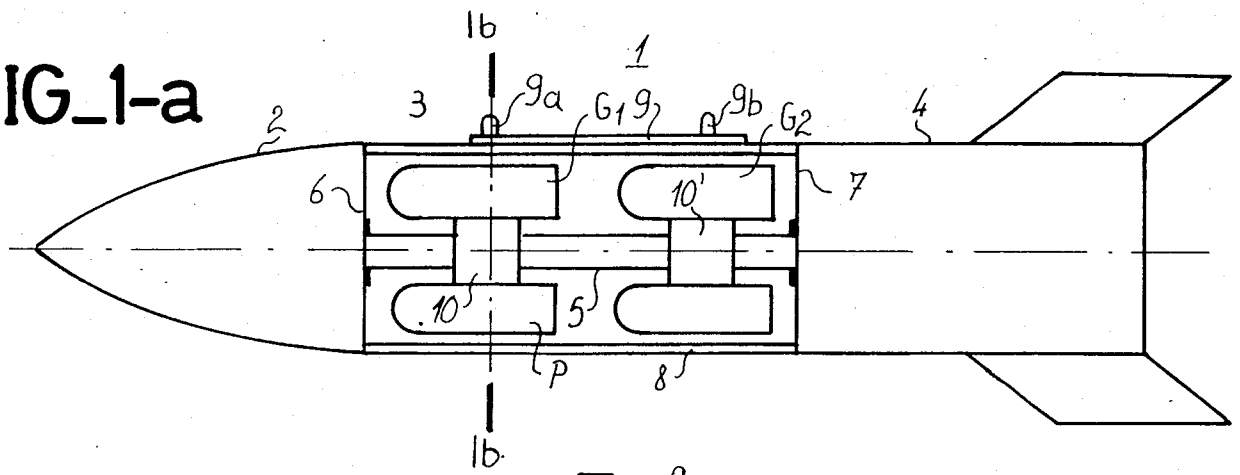
FIG_1-a
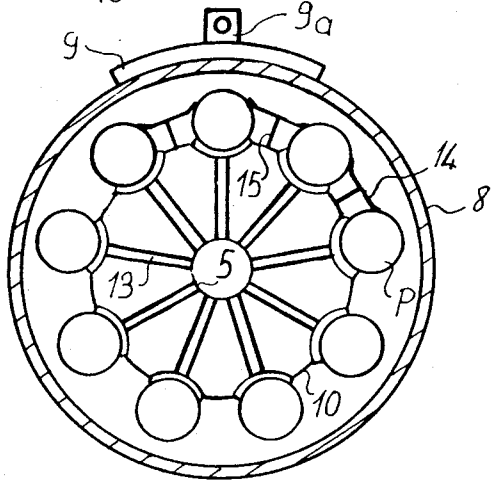
FIG_1-b

MULTI-HEAD MILITARY CHARGE

BACKGROUND OF THE INVENTION

The present invention relates to the field of bombs, missiles and similar charge transporting vehicles, and particularly to a military multi-head charge for such vehicles.

At the present time, the method used for neutralizing the vital installations of the enemy, for example runways of aerodromes, consists in launching against the target salvos of projectiles or warheads installed in clusters on the structure of an aircraft. The main drawback of this method of attack resides in the fact that the carrier aircraft must necessarily fly over the objective, the approach to which is usually particularly well defended.

To avoid the aircraft having to fly over the objective, the invention provides a multi-head military charge whose destructive power is at least equal to that of a salvo of projectiles fired by an aircraft, said multi-head military charge being mounted in a vehicle carried by an aircraft so that this aircraft remains outside the range of the defensive weapons of the enemy.

There then arises the problem of constructing a multi-head military charge in which the sub-ammunition, or projectiles, may be dispersed uniformly over the sensitive part of the objective so as to obtain maximum destructive effects. Since the cost of bombardment missions is high, the reliability of the military charge must be high. Moreover, since the military charge is a consumable material, the accuracy of dispersion and the reliability must not be obtained at the cost of an appreciable increase in the production costs of this charge.

SUMMARY OF THE INVENTION

The invention provides a multi-head military charge intended to be carried by a bomb, a missile or similar charge carrying vehicle. The charge groups of the sub-ammunition, such as projectiles or warheads, are arranged in a ring for extraction radially over the terminal trajectory of the carrier vehicle. This military charge comprises a streamlined carrier structure having an external retractable casing and a central tube which comprises an annular support for each of the groups of projectiles. This annular support comprises, radially disposed opposite the projectiles, actuatable gas ejectors and bolt securing means, which bolts retract under the effect of the movement of the gas ejectors.

BRIEF DESCRIPTION OF THE DRAWINGS

The invention will be better understood from the following detailed description of one embodiment of the present invention, with reference to the accompanying drawings, in which drawings:

FIG. 1*a*, is simplified form, shows an air-to-ground missile comprising a multi-head military charge, FIG. 1*b* is a cross section of the military charge which shows the arrangement of a group of projectiles in a ring.

DESCRIPTION OF THE PREFERRED EMBODIMENT

Figure 2:
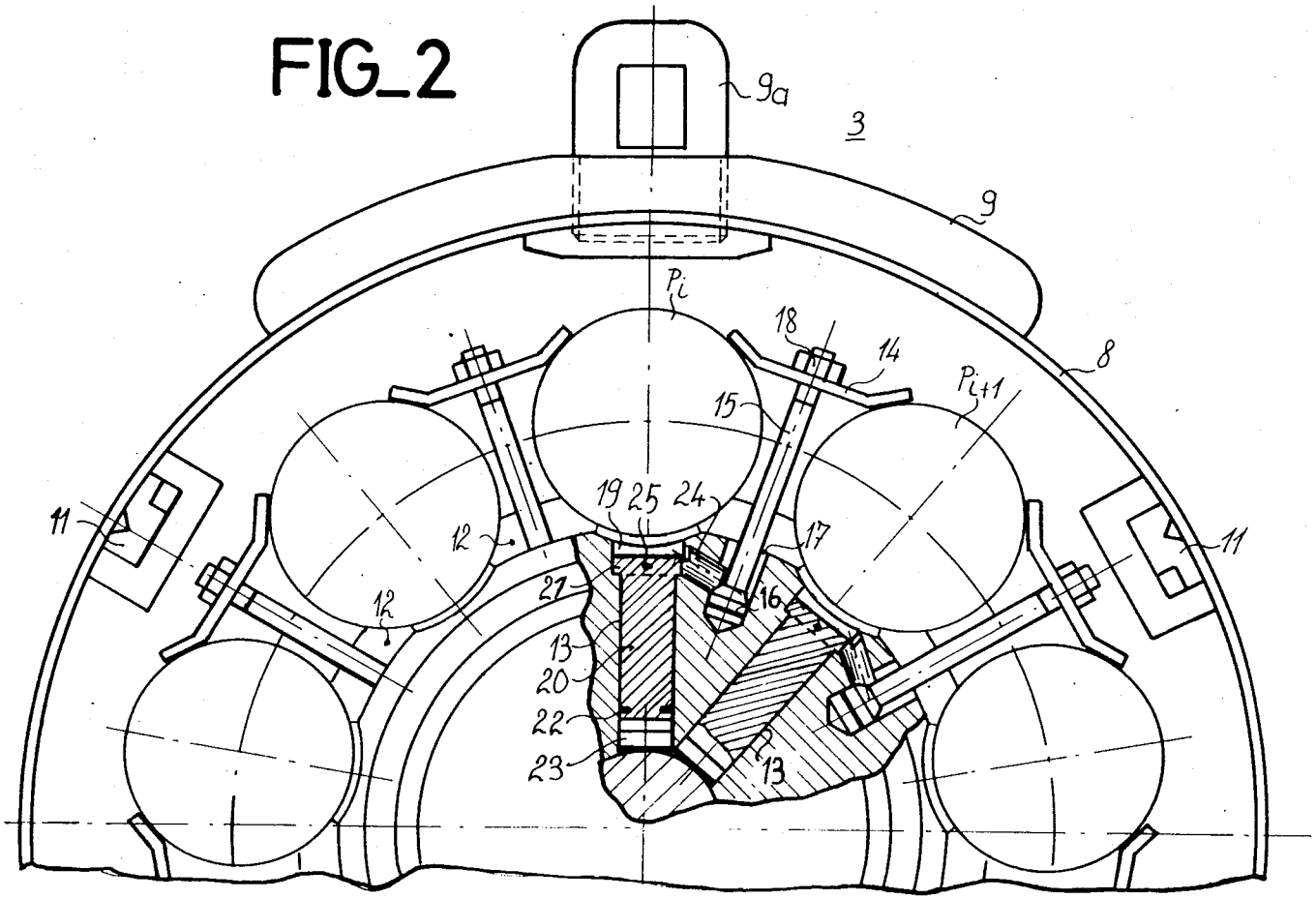
FIG. 2 is a partial view, in cross section, which shows one embodiment of the military charge.

FIG. 1*a* shows in simplified form a missile intended to be carried and launched by an aircraft which remains outside the defense perimeter of the enemy. This missile is equipped with a multi-head military charge. Missile 1 comprises three main sections: a front section 2 ogival in shape in which are grouped the guide means allowing the missile to follow a course to the sensitive point of the objective designated; a middle section 3 formed by the multi-head military charge and a rear finned section 4 which possibly contains the propulsion unit for accelerating the missile which is fired after launching from the carrier aircraft.

The military charge 3 comprises essentially a carrier structure, enclosed in a casing, in which are disposed means for radially ejecting groups $G_1$ and $G_2$ of projectiles P arranged in a ring. The carrier structure for the military charge comprises a central tube 5 connected to two connecting flanges 6 and 7 and to the casing. The connection of the flanges for the casing is temporary, and the casing includes fragmentation or sliding means for completely uncovering the projectile a short while before they are ejected from the military charge.

Casing 8 is fitted with a rigid beam 9, having rings 9*a* and 9*b* for fixing to the aircraft, not shown. The central tube 5 of the carrier structure has annular supports 10 and 10' to which the projectiles are fixed. In the annular support are disposed ejectors whose function is to eject each of the projectiles P radially, said projectiles are secured to their supports by securing means which are unlockable in synchronism with the movement of the ejectors.

On approaching the appointed objective, missile 1 is released by the carrier aircraft then guided towards the sensitive point. In the vicinity of this sensitive point casing 8 of the military charge is expelled; then, conjointly, the means for securing the projectiles P are unlocked and then the ejectors are actuated so as to impart to the projectiles a given lateral ejection speed, which conditions the dispersion of the projectiles on the ground.

Depending on the nature of the objective, the type of sub-ammunition used and the firing parameters, the ejection speed is between a few meters and a few tens of meters per second. It may be noted that it is possible to provide different ejection speeds for the different groups of projectiles by dimensioning the ejectors.

FIG. 1*b* is a cross section taken along line 1*b*—1*b* of the military charge. The projectiles P resting on the annular support 10 are secured by resilient straps 14 having clamping means 15 which are unlocked when the projectiles are expelled by the gas ejectors 13.

FIG. 2 is a partial view in cross section of one construction of a multi-head military charge according to the invention, which shows the elements associated with the annular support 10. The outer casing 8 is equipped with a rigid beam 9 having securing means, such as ring 9*a*. This casing includes pyrotechnical means 11 for causing fragmentation of the casing before projectiles P are ejected. The number of fragmentation generatrices is not limited to 3, as in the embodiment shown here, but may be more. Similar pyrotechnical means (not shown) free the fragments of the casing from the flanges of the carrier structure. Since the techniques for retracting the streamlining elements of missiles and rockets are widely known, they will not be described. The annular support 10 comprises, at its periphery, seats 12 on which the bodies of the projectiles rest, spaced evenly apart. In the annular support 10 are incorporated gas ejectors 13 which are disposed radially and opposite each of the projectiles. The projectiles are held rigidly in position on their seats by a resilient strap 14 whose ends press against the body of the adjacent projectiles Pi and Pi+1. The median part of these holding straps is provided with a clamping rod 15 which comprises a conical base 16 which is engaged in a housing 17 situated in the annular support 10 and in the plane of the pneumatic ejectors 13. The head of the clamping rod 15 is provided with a threaded portion which receives a clamping nut 18. The gas ejector 13 comprises a stepped bore 19 inside which is placed a piston 20. This piston comprises a thrust head 21 which is in abutment against the shoulder of the bore; this thrust head provides a means for locking the clamping rod 15 of the resilient strap 14. The base of the piston is equipped with a sealing means, such as an O seal 22, which opposes the passage of the gases released by a capsule of a pyrotechnique substance which is fired, preferably electrically. In a variant which will be described later on, the base of bores 19 communicates with a gas source situated on the axis of the annular support. Base 16 of clamping rod 15 and the thrust head 20 of the gas ejector communicate with each other through a housing, inside which is placed the locking member (a bolt) 24, which may freely slide out of the housing 17 for the clamping rod during the translational movement of the piston, as soon as the thrust head 21 leaves the shoulder of the stepped bore 19. It will be noted that a pin 25, shearable under the effect of the movement of the piston, is disposed in the piston head so as to hold this latter against the shoulder of the bore.

After the operation for expelling the military charge from casing 8, which operation uncovers the projectiles, ignition of the pyrotechnique capsule 23 produces a gas flow which pushes the piston 20 of the ejector outwardly. The head of piston 21 is progressively freed and frees the locking member 24. This locking member, under the effect of the resilient constraint of strap 14 transmitted by the clamping rod 15, moves towards the body of the piston and completely frees the housing 17 for base 16 of the clamping rod. The head of the piston 21 continues its movement and comes into contact with the body of the projectile against which it exerts a pressure force which ensures ejection of the projectile. By a judicious choice of the characteristics of the ejector, the ejection speed of the projectile may be controlled.

Figure 3:
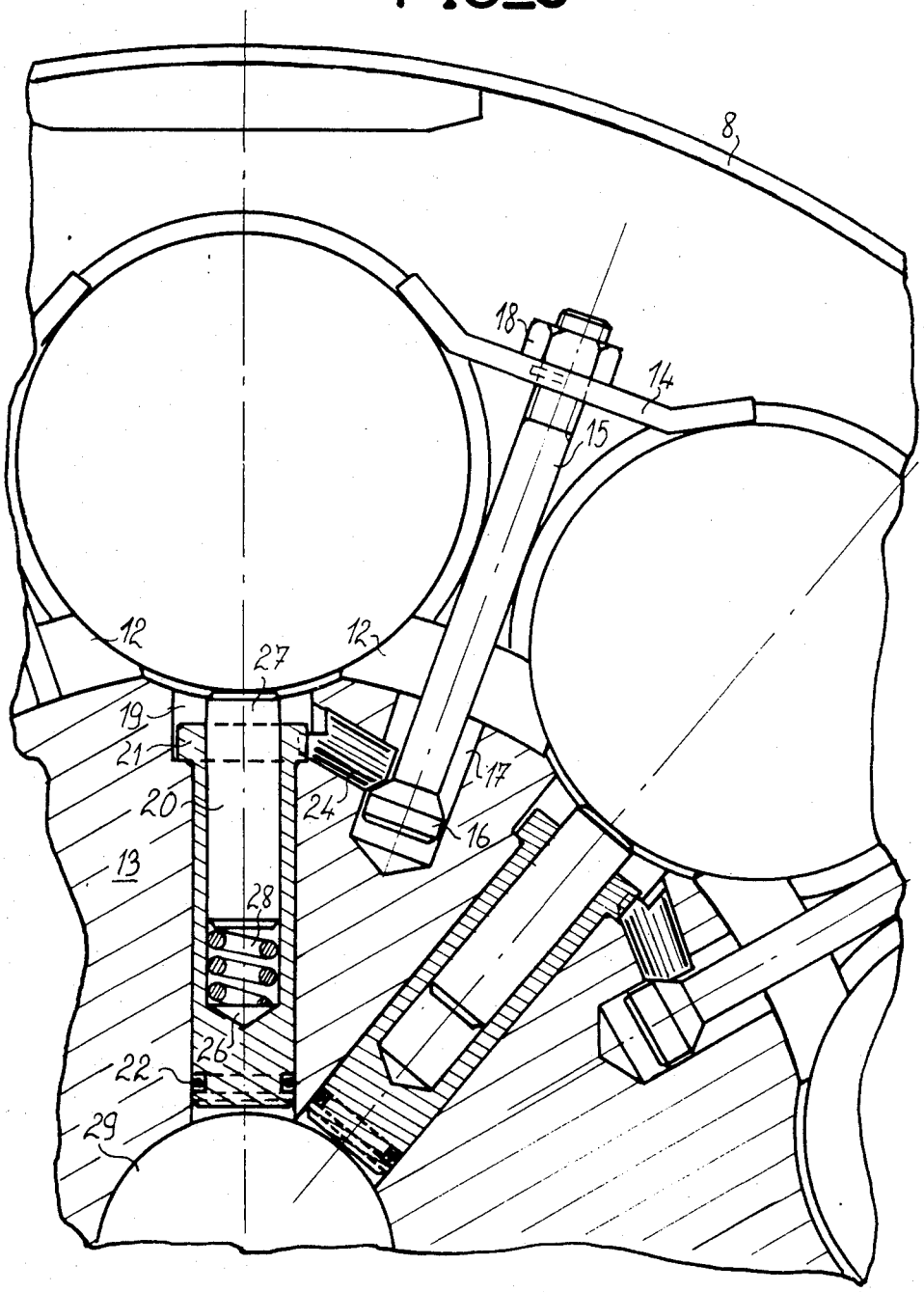
FIG. 3 is a partial view, in cross section, which shows the details for constructing the gas ejectors.

FIG. 3 shows in a sectional view a variant of the construction of the gas ejectors. The purpose of this constructional variant is to prevent the piston head 21 from striking the body of the projectile and it eliminates the above described shear pin 25. Inside the piston is provided a bore 26 which receives a thrust rod 27. The upper end of the thrust rod is held in contact with the body by a resilient means 28 disposed between the lower end of this thrust rod and the bottom of bore 26. This resilient means 28 may be formed by a helical spring, a stack of "belleville" washers or any other equivalent means. The purpose of spring 28 is also to delay application of the thrust force to the projectile as long as the locking member 24 of the clamping rod 15 has not been retracted. The lower ends of bores 19 of the gas ejectors are in communication with the central cavity 29 in which is disposed a gas generator which will be described further on.

Figure 4:
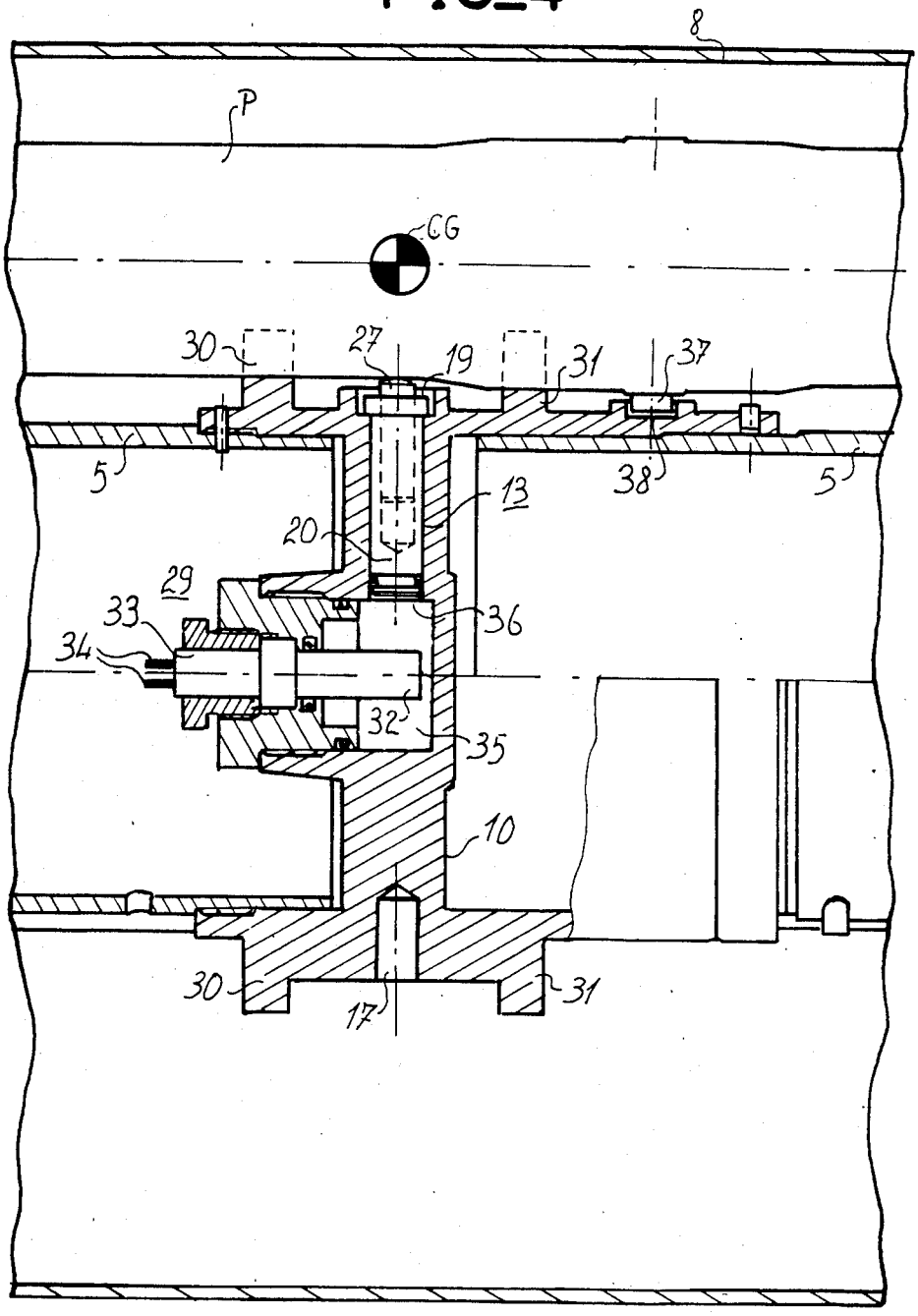
FIG. 4 is a partial view, in longitudinal section, showing the details for constructing the annular support for the projectiles.

FIG. 4 is a partial view in longitudinal section of the military charge which shows the details of construction of the annular support of a group containing an uneven number of projectiles P. The annular support 10 is a solid element which fits onto the central tube 5 of the carrier structure. On the periphery of the annular support, on each side of the gas ejectors 13, are situated two series of projections 30 and 31 forming the seats 12 on which the bodies of the projectiles rest. The two series of projections are sufficiently removed from each other to provide a suitable seat for the projectiles. Projections 30 and 31 provide preferably pin point contacts with the body of the projectiles and these contact points are advantageously situated in diametrical planes which contain the elastic forces exerted by the above described straps 14. The central part of the annular support comprises a detonatable gas generator 29. The gas generator comprises a tube 32 in which is placed a pyrotechnique substance and an electric fuse 33 having its electric terminals 34. A chamber 35 situated concentrically with respect to tube 32 of the gas generator, comprises orifices 36 for communicating with the gas ejectors. In this FIG. 4 there is shown, diametrically to the gas ejector shown, the housing 17 of one of the clamping rods for the straps holding the projectiles. For positioning the projectiles longitudinally, they are provided with a longitudinal positioning element such as stud 37. This stud is freely engaged in a hollow recess 38 so as not to disturb the ejection of the corresponding projectile. Stud 37 situated in the body of the projectiles may be a retractable element for neutralizing the arming of the projectile. The point of application of the thrust force provided by the thrust head 27 of the gas ejectors is situated accurately with respect to the center of gravity CG of the projectiles.

Figure 5:
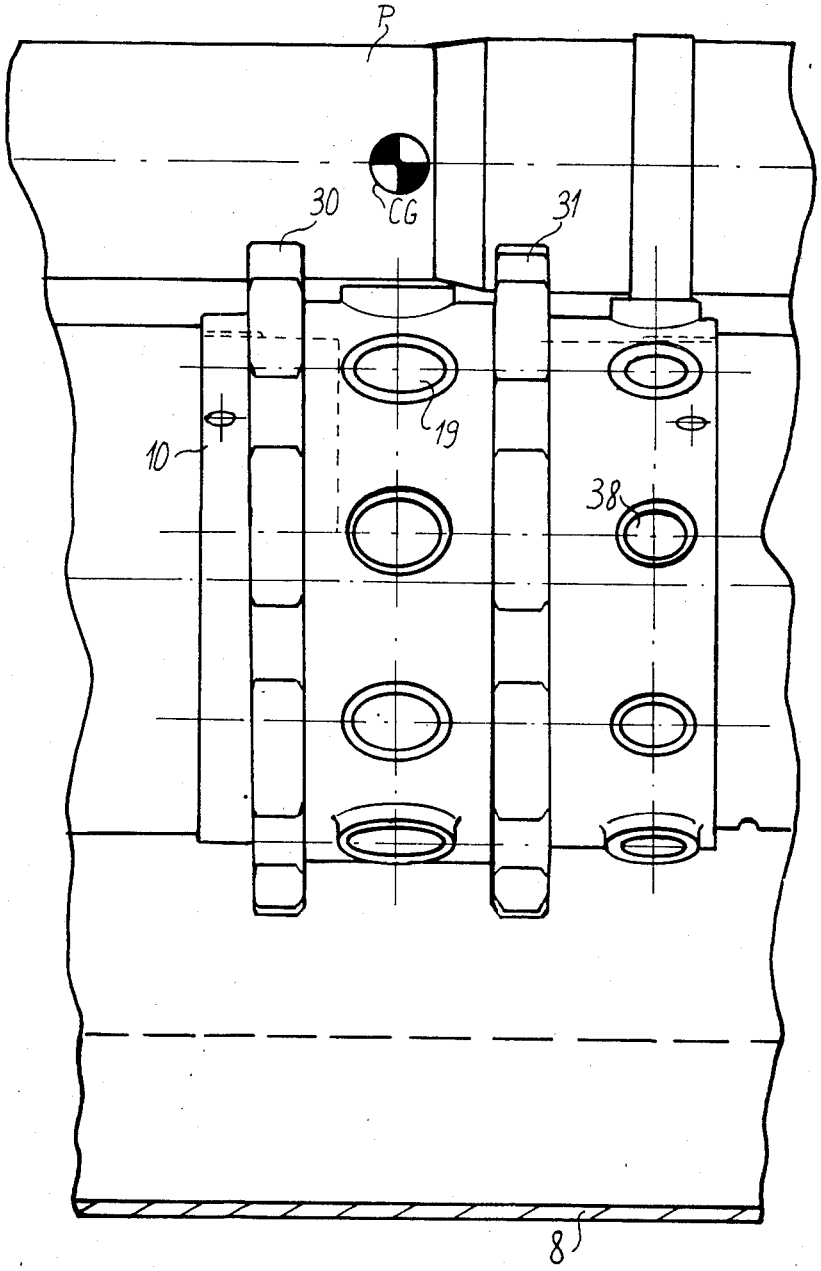
FIG. 5 shows an external view of the annular support for the projectiles.

FIG. 5 shows an external view of the annular support 10 for the projectiles and it shows the following elements: the two series of projections 30 and 31 which provide seats for the bodies of the projectiles; the outlet orifices of the stepped bore of the gas ejectors and the hollow recess 38 which receives the longitudinal positioning elements for the projectiles.

Figure 6:
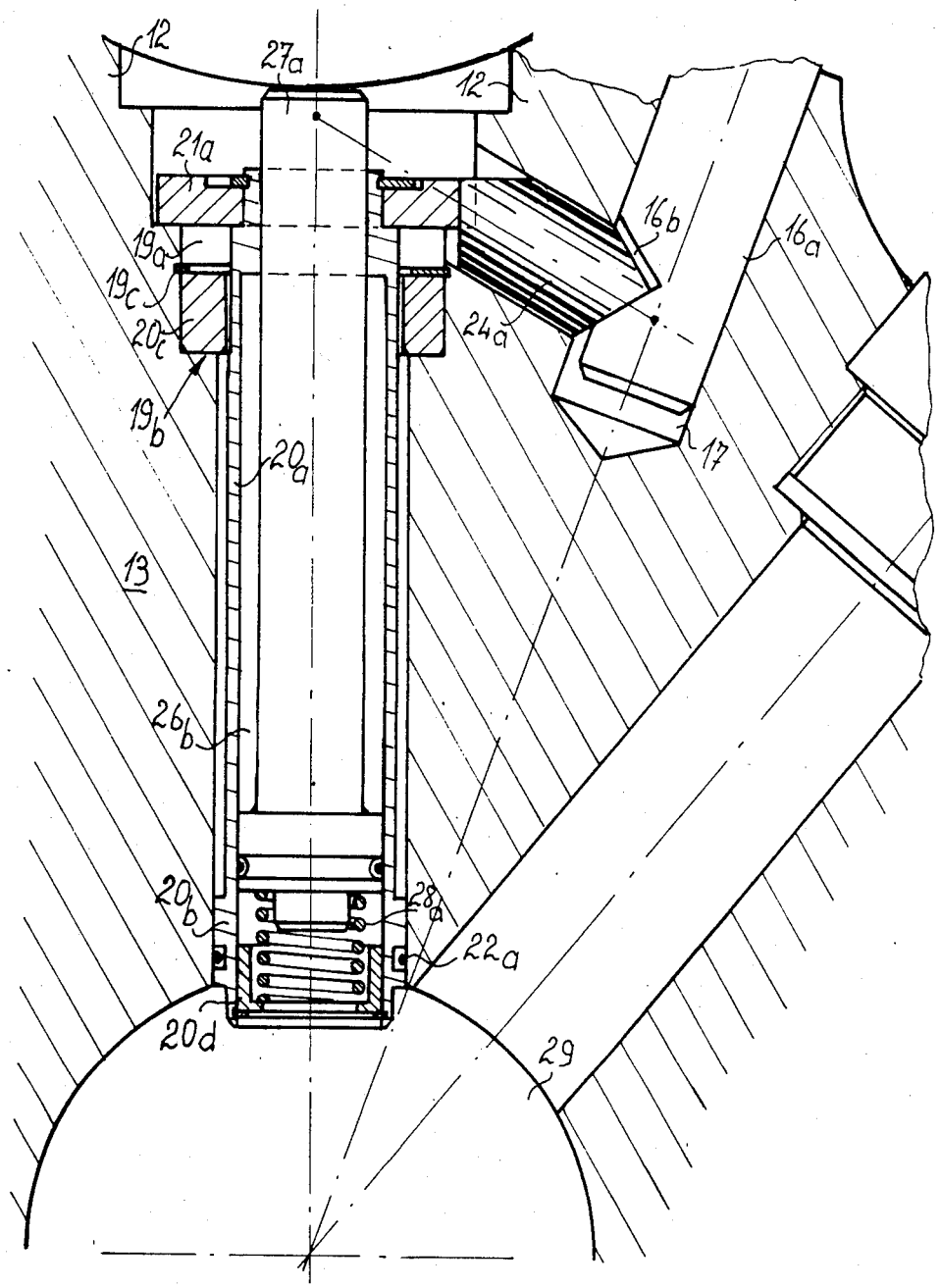
FIG. 6 is a sectional view which shows a variant of the gas ejectors.

FIG. 6, in a sectional view, shows a constructional variant of the gas ejector and of the means for electrically locking the clamping rod of the strap for holding the projectiles on the annular support. The gas ejector 13 is of the telescopic type comprising a hollow external piston **20*a* placed in this stepped bore 19*a* and an internal piston 27*a*. The external piston 20*a* comprises at its base a boss 20*b* the purpose of which is to provide a first bearing surface on the wall of the stepped bore 19*a*; the second bearing surface is provided by a ring 20*c* bearing on a complementary shoulder 19*b* of the stepped bore; this ring 20*c* being held in place by a circlip 19*c*. The base of the external piston 20*a* comprises a bearing piece 20*b* for a spring 28*a* which also bears against the base of the internal piston, 27*a*. The upper part of the external piston comprises a piston head 20*a* which provides locking of part 24*a* which blocks the base 16*a* of the clamping rod 15 of the resilient strap 14. The base 16*a* of clamping rod 15 is cylindrical in shape so as to provide perfect guiding thereof in housing 17 and it comprises a countersunk portion 16*b* in which the locking member 24*a*** may be engaged. The form of construction which has just been described allows a considerable lateral ejection force to be imparted to the projectiles when that proves necessary and, conjointly, it ensures improved guiding of the clamping rod of the resilient strap holding the projectiles.

The form of construction of the streamlined carrier structure may be varied and, more particularly the means for retracting the casing may be of a type with extraction along the longitudinal axis of the missile.

The advantages provided by the invention can now be seen more clearly: spacing between projectiles is reduced to a minimum so as to confer on the charge maximum carrying capacity; the means for fixing and ejecting the projectiles operate in perfect synchronism and cooperate judiciously so as to provide uniform and controlled dispersion of the projectiles, and the simplicity of the mechanisms confer a certain reliability on the military charge.

The invention is not limited in its applications to a military charge formed of projectiles, but it may be applied to the launching of explosive mines, different ammunition etc which must be deposited on the ground.

What is claimed is:

1. Dispensing apparatus for a multiple-projectile delivery vehicle, comprising:

carrier means having an ejectable casing and a central tube which has at least one support for supporting said projectiles;

a plurality of gas ejectors radially disposed inside said carrier means, each ejector being located adjacent a respective projectile for ejecting said projectile from said carrier means, each gas ejector including a piston disposed in a stepped bore having a shoulder situated in said annular support, said piston having a head held in contact with said shoulder of said stepped bore, each piston including a blind bore in which is placed a thrust rod which is held against said associated projectile by resilient means disposed between a bottom of said blind bore in a base of said thrust rod; and securing means for securing said projectiles inside said carrier means, said securing means having a plurality of bolts which release said securing means in response to an initial movement of the said gas ejectors.

2. A multi-head military charge apparatus for carrying vehicles having a plurality of sub-ammunition projectiles arranged in a ring for radial ejection, comprising:

carrier means, having an ejectable casing and a central tube which has at least one annular support on which the projectiles rest, for carrying said projectiles;

a plurality of trippable gas ejectors radially disposed inside said carrier means with each trippable gas ejector being located opposite a respective projectile, for ejecting said projectiles from said carrier means; and securing means for securing the projectiles inside said carrier means, said securing means having a plurality of bolts which release said securing means in response to movement of the gas ejectors;

each said gas ejector including a piston disposed in a stepped bore having a shoulder situated in the said annular support, said piston comprising a head held in contact with the shoulder of the stepped bore and having a side facing a corresponding one of said bolts, each piston having a blind bore in which is placed a thrust rod which is held pressed against the body of the associated projectile by resilient means disposed between the bottom of the blind bore and a base of said thrust rod.

3. The apparatus as claimed in claim 1, wherein the stepped bore of each of the gas ejector is a bore in which is disposed a capsule of an explosive substance.

4. The apparatus as claimed in claim 1, wherein a base of each stepped bore of the gas ejectors has an orifice in communication with a single gas generator disposed in a central part of said annular support.

5. The apparatus as claimed in claim 1, wherein a base of each piston of said gas ejectors is in communication with an annular chamber of a gas generator situated in a central part of said annular support.

6. The apparatus as claimed in claim 2, wherein said gas ejectors are telescopic and each ejector includes a piston having a head for locking an associated bolt to temporarily prevent the release of said securing means.

7. The apparatus as claimed in claim 2, wherein each said projectile includes first positioning means, and wherein said annular support includes a plurality of second positioning means each one situated opposite a corresponding one of said first positioning means, for ensuring a precise longitudinal positioning of the projectiles with respect to said gas ejectors.

8. The apparatus as claimed in claim 2, wherein said securing means include a plurality of resilient members, each member having two ends which are respectively in contact with two adjacent projectiles, each member being provided in its middle part with a clamping rod including a lockable base, said lockable base being engaged inside a bore formed in said annular support.

9. The apparatus as claimed in claim 8, wherein each second positioning means includes a retractable element for neutralizing an arming of the corresponding projectile.

10. Dispensing apparatus for a multiple-warhead delivery vehicle, comprising:

central support means adapted to be connected to said delivery vehicle;

warhead support means, connected to said central support means, adapted for supporting the warheads;

a plurality of resilient restraining means adapted for holding said warheads on said warhead support means, said restraining means including a resilient strap, a rod coupled to said strap, and a bolt holding said rod against a resilient force of said strap; and a plurality of ejectors for simultaneously releasing said restraining means and ejecting said warheads from said warhead support means, each ejector having a piston whose initial movement causes said bolt to release said rod to allow said strap to release said warhead.

* * * * *